US008528796B1

(12) United States Patent
Bosko et al.

(10) Patent No.: US 8,528,796 B1
(45) Date of Patent: Sep. 10, 2013

(54) SOCK DONNING APPLIANCE

(76) Inventors: Richard K. Bosko, Saltsburg, PA (US); Kenneth Bogle, Saltsburg, PA (US)

( * ) Notice: Subject to any disclaimer, the term of this patent is extended or adjusted under 35 U.S.C. 154(b) by 4 days.

(21) Appl. No.: 13/166,992

(22) Filed: Jun. 23, 2011

(51) Int. Cl.
*A47G 25/90* (2006.01)

(52) U.S. Cl.
USPC ..... 223/112; 223/111

(58) Field of Classification Search
USPC ..... 223/112, 111, 113, 118, 119; D2/642
See application file for complete search history.

(56) References Cited

U.S. PATENT DOCUMENTS

| | | | | |
|---|---|---|---|---|
| 4,130,226 | A * | 12/1978 | Farrell | 223/111 |
| D275,239 | S | 8/1984 | Raso | |
| 4,756,453 | A * | 7/1988 | Pettit et al. | 223/111 |
| 5,050,783 | A | 9/1991 | Hunter | |
| 5,303,856 | A * | 4/1994 | Weatherholt, Sr. | 223/111 |
| 5,593,071 | A * | 1/1997 | Lusk | 223/112 |
| 5,626,269 | A | 5/1997 | Duarte | |
| 5,927,573 | A * | 7/1999 | Votino et al. | 223/111 |
| 6,056,171 | A | 5/2000 | Santamaria | |
| 6,102,262 | A * | 8/2000 | Nicholson | 223/112 |
| 6,834,785 | B2 | 12/2004 | Kneth | |
| 6,932,252 | B2 | 8/2005 | Simmons | |
| 2006/0027612 | A1 * | 2/2006 | Boaron | 223/111 |
| 2007/0095866 | A1 * | 5/2007 | Zumbach | 223/111 |
| 2008/0185407 | A1 * | 8/2008 | Wilkens | 223/112 |
| 2009/0120975 | A1 * | 5/2009 | Schoepe | 223/111 |

* cited by examiner

*Primary Examiner* — Nathan Durham

(57) ABSTRACT

A sock donning appliance is provided for allowing a person to put on a sock with minimal physical exertion or bending. The appliance includes a pole having a top end and a bottom end. A plate is coupled to the bottom end of the pole. A support bracket is coupled to the pole and has opposed side portions whereby the support bracket is configured for holding a top end of a sock in an open position.

17 Claims, 5 Drawing Sheets

SOCK DONNING APPLIANCE

BACKGROUND OF THE DISCLOSURE

Field of the Disclosure

The disclosure relates to sock donning devices and more particularly pertains to a new sock donning device for allowing a person to put on a sock with minimal physical exertion or bending.

SUMMARY OF THE DISCLOSURE

An embodiment of the disclosure meets the needs presented above by generally comprising a pole having a top end and a bottom end. A plate is coupled to the bottom end of the pole. A support bracket is coupled to the pole and has opposed side portions whereby the support bracket is configured for holding a top end of a sock in an open position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
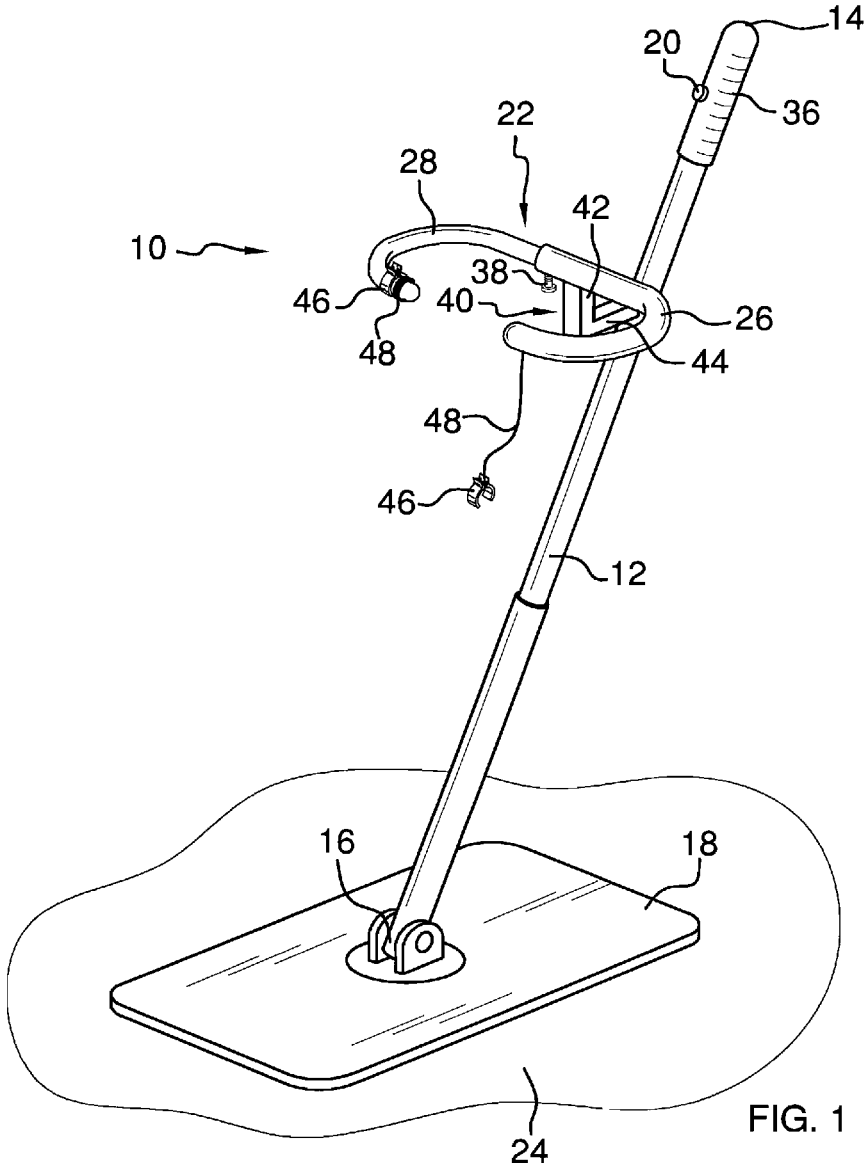
FIG. 1 is a top front side perspective view of a sock donning appliance according to an embodiment of the disclosure.
Figure 2:
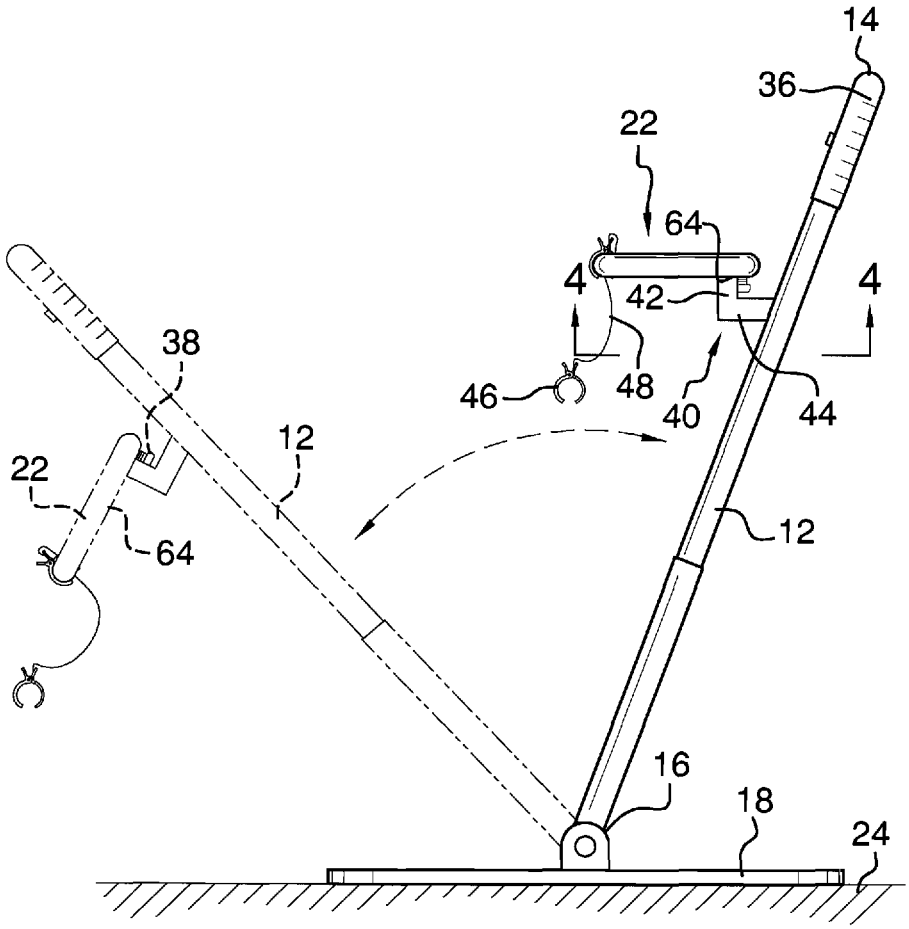
FIG. 2 is a side view of an embodiment of the disclosure.
Figure 3:
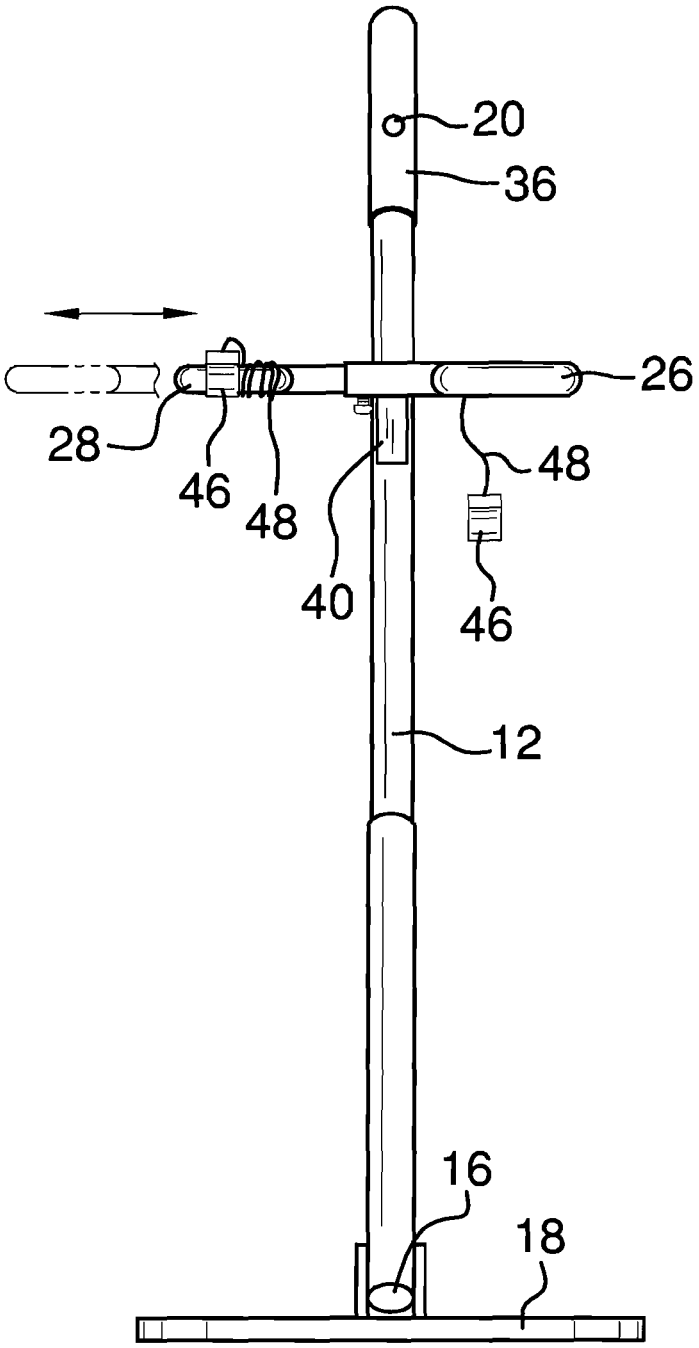
FIG. 3 is a front view of an embodiment of the disclosure.
Figure 4:
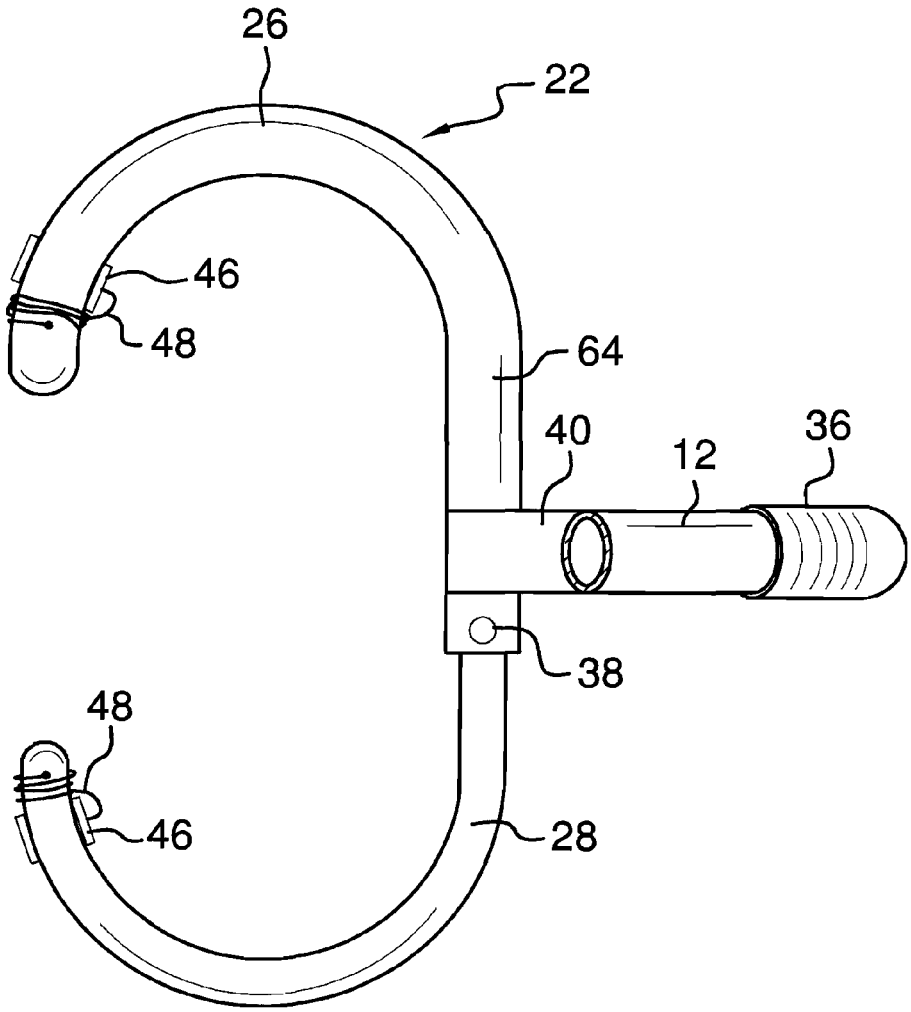
FIG. 4 is a bottom view of an embodiment of the disclosure.
Figure 5:
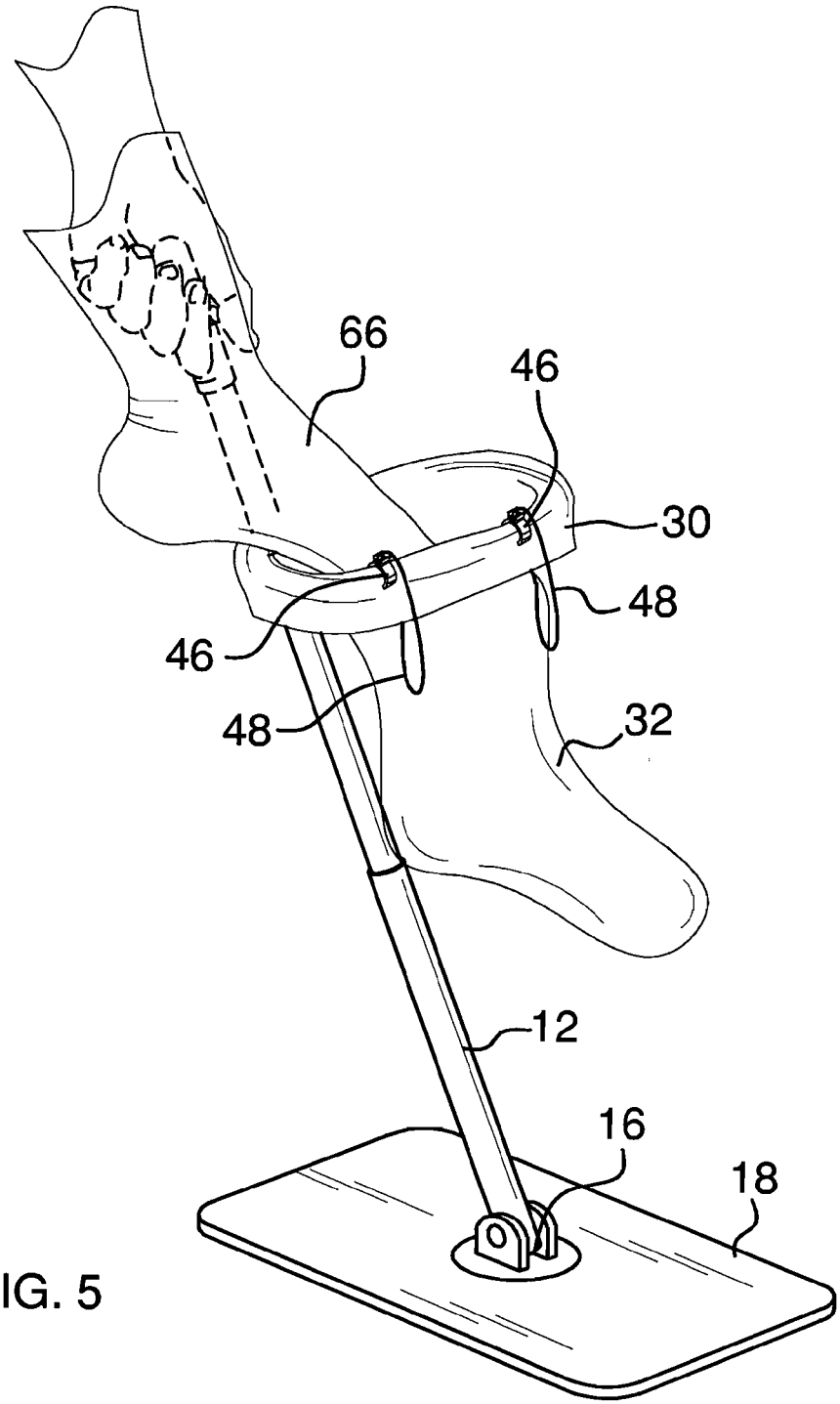
FIG. 5 is a top front side perspective view of an embodiment of the disclosure in use.

With reference now to the drawings, and in particular to FIGS. 1 through 5 thereof, a new sock donning device embodying the principles and concepts of an embodiment of the disclosure and generally designated by the reference numeral 10 will be described.

As best illustrated in FIGS. 1 through 5, the sock donning appliance 10 generally comprises a telescopic pole 12 having a top end 14 and a bottom end 16. A grip 36 may be coupled to the top end 14 of the pole 12. A push button 20 may be positioned proximate the top end 14 of the pole 12 to facilitate manipulation of the push button 20 by a person grasping the pole 12. The push button 20 may be operationally coupled to a release mechanism that permits expansion or contraction of the pole 12 using conventionally known structure for selectively locking a telescopic pole such as the pole 12 into a desired length.

A plate 18 is pivotally coupled to the bottom end 16 of the pole 12. The plate 18 provides a broad base and frictional engagement to a supporting surface 24 preventing slippage of the appliance 10 during use. A support bracket 22 is coupled to the pole 12. The support bracket 22 has opposed side portions 26,28 whereby the support bracket 22 is configured for holding a top end 30 of a sock 32 in an open position 34. The side portions 26,28 of the support bracket 22 include a static side portion 26 relative to the pole 12 and a movable side portion 28 relative to the pole 12. The movable side portion 28 is slidably inserted into the static side portion 26. A set screw 38 is coupled to the static side portion 26 of the support bracket 22. The set screw 38 engages the movable side portion 28 to hold the movable side portion 28 in a static position relative to the static side portion 26.

A connection bracket 40 is coupled to and extends between the pole 12 and the static side portion 26 of the support bracket 22. The connection bracket 40 is L-shaped having a distal arm 42 relative to the pole 12 and a proximal arm 44 relative to the pole 12. The distal arm 42 couples to a bottom side 64 of the static side portion 26 of the support bracket 22. Thus, the proximal arm 44 of the connection bracket 40 relative to the pole 12 is positioned in vertically spaced relationship to the support bracket 22 to prevent interference with the top end 30 of the sock 32. A clip 46, or a pair of clips 46, is removably coupled to the support bracket 22. Each clip 46 is configured for coupling the sock 32 to the support bracket 22. A tether line 48 may be employed to couple to and extend between the clip 46 and the support bracket 22.

In use, the support bracket 22 is adjusted to the desired size and spacing for the individual user. The set screw 38 is tightened to hold the support bracket 22 in the desired position. The sock 32 is then positioned on the support bracket 22 and the clips 46 are used to hold the sock 32 in the open position 34. The pole 12 may be adjusted to a desired length. The plate 18 is positioned on the supporting surface 24 to hold the bottom end 16 in place. The user may then insert a foot 66 through the top end 30 of the sock 32 and pivot the pole 12 as desired to facilitate insertion of the foot 66 into the sock 32. When the foot 66 is fully inserted into the sock 32 the clips 46 are removed. The clips 46 may be immediately released without fear of losing the clips 46 because the clips 46 are secured to the support bracket 22 by tether lines 48. The appliance 10 may be used again for a second sock or may be stored until needed again.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A sock donning appliance comprising:

a pole having a top end and a bottom end;

a plate coupled to said bottom end of said pole; and a support bracket coupled to said pole, said support bracket having opposed side portions whereby said support bracket is configured for holding a top end of a sock in an open position, said side portions of said support bracket including a static side portion relative to said pole and a movable side portion relative to said pole, said movable side portion being slidably inserted into said static side portion.

2. The appliance of claim 1, further including said pole being telescopic.

3. The appliance of claim 1, further including a grip coupled to said top end of said pole.

4. The appliance of claim 1, further including said plate being pivotally coupled to said bottom end of said pole.

5. The appliance of claim 1, further including a set screw coupled to said static side portion of said support bracket, said set screw engaging said movable side portion to hold said movable side portion in a static position relative to said static side portion.

6. The appliance of claim 1, further including a connection bracket coupled to and extending between said pole and said static side portion of said support bracket.

7. The appliance of claim 6, further including said connection bracket being L-shaped, said connection bracket having a distal arm relative to said pole, said distal arm coupling to a bottom side of said static side portion of said support bracket whereby a proximal arm of said connection bracket relative to said pole is positioned in spaced relationship to said support bracket.

8. The appliance of claim 1, further including a clip removably coupled to said support bracket whereby said clip is configured for coupling the sock to said support bracket.

9. A sock donning appliance comprising:

a pole having a top end and a bottom end;

a plate coupled to said bottom end of said pole;

a support bracket coupled to said pole, said support bracket having opposed side portions whereby said support bracket is configured for holding a top end of a sock in an open position, said side portions of said support bracket including a static side portion relative to said pole and a movable side portion relative to said pole, said movable side portion being slidably inserted into said static side portion;

a clip removably coupled to said support bracket whereby said clip is configured for coupling the sock to said support bracket; and a tether line coupled to and extending between said clip and said support bracket.

10. The appliance of claim 9, further including said pole being telescopic.

11. The appliance of claim 9, further including a grip coupled to said top end of said pole.

12. The appliance of claim 9, further including said plate being pivotally coupled to said bottom end of said pole.

13. The appliance of claim 9, further comprising a set screw coupled to said static side portion of said support bracket, said set screw engaging said movable side portion to hold said movable side portion in a static position relative to said static side portion.

14. The appliance of claim 9, further including a connection bracket coupled to and extending between said pole and said static side portion of said support bracket.

15. The appliance of claim 14, further including said connection bracket being L-shaped, said connection bracket having a distal arm relative to said pole, said distal arm coupling to a bottom side of said static side portion of said support bracket whereby a proximal arm of said connection bracket relative to said pole is positioned in spaced relationship to said support bracket.

16. The appliance of claim 9, further including a clip removably coupled to said support bracket whereby said clip is configured for coupling the sock to said support bracket.

17. A sock donning appliance comprising:

a telescopic pole having a top end and a bottom end;

a plate pivotally coupled to said bottom end of said pole;

a support bracket coupled to said pole, said support bracket having opposed side portions whereby said support bracket is configured for holding a top end of a sock in an open position, said side portions of said support bracket including a static side portion relative to said pole and a movable side portion relative to said pole, said movable side portion being slidably inserted into said static side portion;

a grip coupled to said top end of said pole;

a set screw coupled to said static side portion of said support bracket, said set screw engaging said movable side portion to hold said movable side portion in a static position relative to said static side portion;

a connection bracket coupled to and extending between said pole and said static side portion of said support bracket, said connection bracket being L-shaped, said connection bracket having a distal arm relative to said pole, said distal arm coupling to a bottom side of said static side portion of said support bracket whereby a proximal arm of said connection bracket relative to said pole is positioned in spaced relationship to said support bracket;

a clip removably coupled to said support bracket whereby said clip is configured for coupling the sock to said support bracket; and a tether line coupled to and extending between said clip and said support bracket.

* * * * *